US012714137B2

(12) United States Patent
Jude et al.

(10) Patent No.: US 12,714,137 B2
(45) Date of Patent: Aug. 25, 2026

(54) WRAPPER FOR SMOKING ARTICLES WITH CAST-LIKE PROPERTIES

(71) Applicant: Mativ Holdings, Inc., Alpharetta, GA (US)

(72) Inventors: Rama Jude, Slingerlands, NY (US); Dwayne Hotaling, Ghent, NY (US)

(73) Assignee: SWM Holdings US, LLC, Atlanta, GA (US)

( * ) Notice: Subject to any disclaimer, the term of this patent is extended or adjusted under 35 U.S.C. 154(b) by 481 days.

(21) Appl. No.: 18/360,368

(22) Filed: Jul. 27, 2023

(65) Prior Publication Data

US 2024/0032586 A1 Feb. 1, 2024

Related U.S. Application Data

(60) Provisional application No. 63/392,601, filed on Jul. 27, 2022.

(51) Int. Cl.

| | |
|---|---|
| ***A24D 1/02*** | (2006.01) |
| ***A24D 1/00*** | (2020.01) |
| ***A24D 1/18*** | (2006.01) |

(52) U.S. Cl.
CPC ..... *A24D 1/025* (2013.01); *A24D 1/002* (2013.01); *A24D 1/18* (2013.01)

(58) Field of Classification Search
None
See application file for complete search history.

(56) References Cited

U.S. PATENT DOCUMENTS

| | | | | |
|---|---|---|---|---|
| 11,388,925 | B2 * | 7/2022 | Rousseau | A24B 15/16 |
| 11,963,547 | B2 * | 4/2024 | Rousseau | D21H 11/12 |
| 2019/0373948 | A1 * | 12/2019 | Zhao | A24D 1/002 |

* cited by examiner

*Primary Examiner* — Dennis R Cordray
(74) *Attorney, Agent, or Firm* — Dority & Manning, P.A.

(57) ABSTRACT

Wrapping materials are disclosed that are particularly well suited for producing roll-your-own smoking articles. In one aspect, the wrapping materials can be made from extracted *Cannabis* materials optionally combined with web building fibers. The extracted *Cannabis* materials are comminuted to a median particle size of generally less than about 120 microns, such as less than about 80 microns. At least one gum is incorporated into the wrapping material for producing a wrapping material with enhanced strength, very smooth surfaces, and excellent self-adhering properties.

21 Claims, 2 Drawing Sheets

WRAPPER FOR SMOKING ARTICLES WITH CAST-LIKE PROPERTIES

RELATED APPLICATIONS

The present application is based upon and claims priority to U.S. Provisional Patent Application Ser. No. 63/392,601, having a filing date of Jul. 27, 2022, which is incorporated herein by reference.

BACKGROUND

Smoking articles typically include a smokable filler surrounded by a wrapper. The wrapper has traditionally been made from pulp fibers. The wrapper not only surrounds a column of the smokable filler, but also can influence many of the smoking characteristics of the smoking article. The wrapper, for instance, can influence the burning characteristics of the smoking article, the amount of air that is combined with the mainstream smoke during puffing, and the taste characteristics of the smoking article. Although wrappers made from pulp fibers have enjoyed tremendous success in smoking articles containing tobacco fillers, consumers are seeking alternative wrappers when non-conventional smokable fillers are incorporated into the smoking article.

For instance, recently, popularity has grown in the use of smokable fillers made from *Cannabis* and other botanicals. These smokable fillers contain no or reduced levels of nicotine and thus can offer various advantages and benefits to the user. Many of these smoking articles are not mass produced causing consumers to rely on "roll-your-own" wrappers for constructing the smoking articles. Many of these wrappers are produced in a cast process. During a cast process, a slurry of fibers is created that can also contain a binder and a flavorant, such as menthol. The slurry is then cast onto a movable band or screen and subsequently dried to form a sheet that can be used as a wrapper. Cast sheets typically have very smooth surfaces and can be made to self-adhere. Cast sheets, however, can have relatively low strength characteristics. In addition, cast sheets can be somewhat difficult to process on certain subsequent manufacturing lines, such as booklet machines or cigarette makers.

In view of the above, a need currently exists for a process for producing cast-like wrappers that have improved strength characteristics while still producing a sheet with smooth characteristics and that can be self-adhering. A need also exists for a cast-like wrapper as described above that can be made from *Cannabis* and botanical material components.

SUMMARY

In general, the present disclosure is directed to a wrapping material having cast-like properties. The wrapping material of the present disclosure can be formed on a papermaking system and therefore can be rapidly produced with improved strength characteristics. In one embodiment, the wrapping material is made from *Cannabis* components.

For example, in one embodiment, the present disclosure is directed to a wrapping material for a smoking article that includes a web. The web includes extracted plant material including *Cannabis* leaves, *Cannabis* stems (also referred to as hurds), *Cannabis* buds, *Cannabis* flowers, residues from *Cannabis* extraction, or mixtures thereof. In accordance with the present disclosure, the plant material has been reduced in size so as to have a median particle size of less than about 120 microns, such as less than about 100 microns, such as less than about 80 microns, such as less than about 60 microns, and generally greater than about 15 microns, such as greater than about 25 microns, such as greater than about 35 microns, such as greater than about 45 microns. The plant material can be reduced in size before or after being extracted to remove the water soluble components. The web further comprises a gum. The gum can be combined with the extracted plant material during formation of the web, can be impregnated into the web using, for instance, a size press, and/or can be coated onto the web using, for instance, a printing device. In one aspect, the gum can comprise an arabic gum. Other gums that may be used include guar gum, an alginate, a cellulose derivative, or mixtures thereof.

In addition to *Cannabis* components, the web can contain various other components. For instance, the extracted plant material can also comprise tobacco material, botanical components, or mixtures thereof. The web can also comprise web building fibers. The web building fibers can comprise delignified cellulose fibers, such as pulp fibers, bast pulp fibers, or mixtures thereof. In one aspect, the web building fibers comprise hemp pulp fibers.

In addition to a gum, the web can also be treated with a humectant. The humectant may comprise, for instance, a glycerol and can be present in the web in an amount from about 1% to about 25% by weight.

The wrapping material can generally have a basis weight of from about 20 gsm to about 150 gsm, such as from about 25 gsm to about 90 gsm. The wrapping material can have a permeability of from about 40 Coresta to about 100 Coresta. In one embodiment, the wrapping material can have a relatively low permeability. For instance, the permeability can be less than about 40 Coresta, such as less than about 20 Coresta, such as less than about 10 Coresta, such as less than about 5 Coresta, such as less than about 4 Coresta, such as less than about 3 Coresta.

In one embodiment, the web can be calendered in order to further enhance the surface of the web. In addition, the web can be treated with an aerosol delivery composition. The aerosol delivery composition can contain an aerosol delivery agent. In one embodiment, the aerosol delivery agent is an extract derived from the extracted plant material, such as the extracted *Cannabis* material. In one aspect, the aerosol delivery agent can comprise tetrahydrocannabinol, a cannabidiol, or mixtures thereof.

The present disclosure is also directed to a booklet of wrapping materials comprising a stack of individual sheets of wrapping material as described above. The wrapping material can include an adhesive that is present between adjacent sheets of wrapping material for affixing the individual sheets together in a releasable manner. The adhesive, for instance, can comprise the gum that has been applied to the wrapping material.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
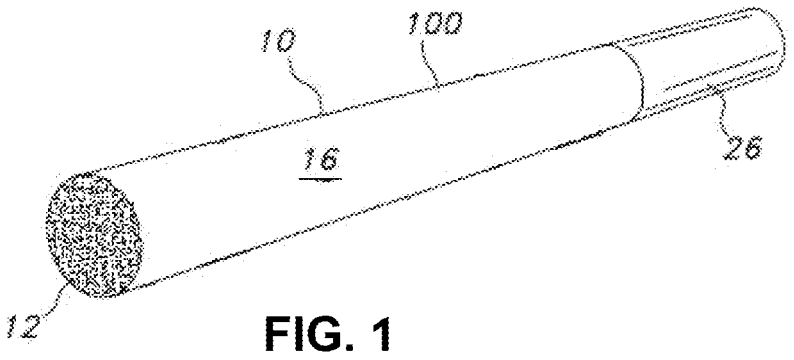
FIG. 1 is a perspective view of one embodiment of a smoking article incorporating the wrapper of the present disclosure.

Repeat use of reference characters in the present specification and drawings is intended to represent the same or analogous features or elements of the present invention.

Definitions

As used herein, "*Cannabis*" may refer to any variety of the *Cannabis* plant, such as *Cannabis sativa* or *Cannabis indica*, for instance. More particularly, the present disclosure may refer to leaves, stems, seeds and flowers or any other part of the *Cannabis* plant, as *Cannabis*. Nonetheless, *Cannabis*, as referred to herein, includes *Cannabis* that contains average or high levels of THC and/or CBD (usually known as marijuana), hemp, which may contain low, or very low, levels of THC, industrial hemp, which may refer to a *Cannabis* plant that contains less than 0.3% THC, or combinations thereof.

As used herein, a "reconstituted plant material" refers to a material formed by a process in which a plant feed stock, such as raw plant material from a *Cannabis* plant, is extracted with a solvent to form an extract of solubles, such as water solubles, and an extracted insoluble portion or residue comprising fibrous material. The extracted and insoluble fibrous material is then formed into a sheet or web through any suitable process and the extract may either be discarded or reapplied to the formed sheet. The extract can be fed through various processes for concentrating the extract and optionally removing or adding various components prior to being recombined with the fibrous material. In the present disclosure, the reconstituted plant material is formed from extracted *Cannabis* fibers, optionally combined with web building fibers, such as cellulose fibers. The extract of solubles obtained from the *Cannabis* fibers is optionally reapplied to the sheet.

As used herein, an "aerosol generating material" is meant to include both a combustible material that undergoes combustion in a smoking article and to an aerosol-forming material that is heated but not combusted to form an inhalable aerosol. Combustible smoking articles can include cigarettes, cigarillos and cigars, pre-rolled cones etc. In a cigarette, the aerosol generating material is generally surrounded by a wrapping material to form a smokable rod, but may also be included in the wrapping material itself. Aerosol generating devices for generating an aerosol include, for instance, devices in which an aerosol is generated by electrical heating or by the transfer of heat from a combustible fuel element or heat source to heat but not burn the aerosol generating material, which releases volatile compounds. As the released compounds cool, they condense to form an aerosol that is inhaled by the consumer.

As used herein, "extracted plant (e.g. botanical or *Cannabis*) material or extracted plant (e.g. *Cannabis*) fibers" refers to plant fibers that have been subjected to an extraction process in which the plant material has been contacted with an aqueous solution to remove greater than 50%, such as greater than 75% of the water soluble components contained in the plant material. The extraction process is different from a delignification process and from a bleaching treatment.

As used herein, "extracted byproducts" refers to *Cannabis* biomass that has been subjected to an extraction process for removing selected components, such as cannabinoids, without removing a substantial amount of water soluble components. The extracted byproducts can be referred to as biomass resulting from an extraction process where the extractant is a solvent, such as ethanol, a supercritical fluid such as carbon dioxide, a lipid such as a vegetable oil, or the like. Extracted byproducts, in accordance with the present disclosure, can be subjected to a second extraction process for removing water soluble components during the process of making a reconstituted *Cannabis* material. Extracted byproducts well suited for use in the present disclosure include those that contain water soluble components in an amount greater than about 8% by weight, such as in an amount greater than about 12% by weight, such as in an amount greater than about 18% by weight, such as in an amount greater than about 24% by weight.

As used herein, "delignified" cellulosic fibers refers to fibers that have been subjected to a pulping or delignification process by which the cellulose fibers are separated from the plant material through chemical means, mechanical means, or through a combination of chemical and mechanical means.

As used herein, the term "refine" is used to mean that the plant material is subjected to a mechanical treatment that modifies the fibers of the material so that they are better suited to forming a fibrous sheet or substrate. Refining can be accomplished using a conical refiner or a disks refiner or a Valley beater. The mechanical process exerts an abrasive and bruising action on the plant material such that the plant material is defibrillated. Refining is a different process than delignification and pulping. The degree of refining of fibers can be measured by the freeness value. The freeness value (° SR) measures generally the rate at which a dilute suspension of refined fibers may be drained. The freeness is measured by the Schopper Riegler Method for drainability. As used herein, freeness is measured according to Test NORM EN ISO 5267-1.

As used herein, the "amount of water soluble extracts" present in a substrate or reconstituted plant material or in an aerosol-generating material is determined by taking 5 grams of a sample in boiling distilled water for 10 minutes to obtain an extract containing water soluble components. The weight of dry matter of the extract that is soluble in the solvent is calculated by the difference between the dry weight of the sample and the dry weight of the sample after extraction. The difference in dry weight is then used to determine the percentage of water soluble extracts in the sample.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a wrapping material for a smoking article that is formed at least in part from non-tobacco extracted plant materials. In one aspect, for instance, the wrapping material is formed from extracted *Cannabis* materials (which includes hemp). The wrapping material of the present disclosure is formed in a manner that produces a wrapper with an extremely smooth surface that has the look and feel of a cast product. The wrapping materials of the present disclosure, however, offer numerous advantages and benefits over cast products made in the past from hemp. In particular, the wrapping materials of the present disclosure can be formed with greater strength, can be formed on papermaking machines that operate at faster throughputs, and can be formed with excellent self-sticking characteristics that are especially desirable in roll-your-own applications. In addition, the wrapping materials of the present disclosure are more natural in appearance and in content in comparison to many cast products.

The wrapping material of the present disclosure is generally produced by subjecting plant material such as *Cannabis* to an extraction process for removing water soluble components. In addition to being subjected to an extraction process, the plant materials are comminuted to a relatively small median particle size. The extracted particles of plant material are then fed through a papermaking process to form a web and treated with a gum and optionally other components to produce a consolidated wrapper. The gum can be applied using various different methods in order to obtain an optimum result. For instance, a gum can be applied to the wrapper for improving not only the look and feel of the wrapper but also can improve tackiness, strength and runnability.

As described above, the wrapping material can be formed from extracted *Cannabis* materials. In an alternative embodiment, the wrapping material can be formed from botanicals. In still another embodiment, the wrapping material can be formed from a mixture of plant materials, such as *Cannabis* materials combined with tobacco materials and/or botanicals. In one aspect, the plant materials that are combined together to form the wrapper are all comminuted to obtain a desired median particle size.

In one embodiment, web building fibers, such as delignified cellulose fibers, can be added to the extracted particles of plant material to form the web. The web building fibers can be added in an amount sufficient to increase strength and integrity. In one embodiment, the wrapping material is formed containing bast pulp fibers, such as hemp pulp fibers.

Various advantages and benefits are obtained when constructing the wrapping material from extracted *Cannabis* materials either alone or in combination with botanical materials. For example, because the reconstituted *Cannabis* material has a natural *Cannabis* taste when smoked and is nicotine free, such wrapping material can be used to produce a nicotine free smoking article that complements and/or mimics the smell and taste of *Cannabis*. For instance, a wrapping material formed from *Cannabis* may add to, or enhance, the taste and/or smell of a smoking article containing *Cannabis*, or may mimic the taste and/or smell of *Cannabis* when it is not desired to consume *Cannabis*, but the taste is still desired. Therefore, a wrapping material according to the present disclosure may provide a replacement for a paper wrapper for use with *Cannabis* or *Cannabis* smokeable articles, or when it is desired to mimic the taste and/or smell of a *Cannabis* or *Cannabis* smokeable article, and may also provide a better sensorial experience.

In addition, the wrapping material is well suited to being combined with aerosol delivery functionality and/or topical additives, which may be jointly referred to as aerosol delivery agents and will be discussed in greater detail below. For instance, due to its good carrier properties, the wrapping material may also be combined with an aerosol delivery agent or have an aerosol delivery agent applied thereto. In one embodiment, for instance, the water soluble extract collected from the extracted plant material can be concentrated, filtered, and/or combined with other components and applied back to the web used to form the wrapping material.

When producing the wrapping material from *Cannabis* materials, the type of *Cannabis* materials incorporated into the wrapping paper can vary. *Cannabis* materials for use in the present disclosure are obtained from a *Cannabis* plant, and thus, may be referred to as *Cannabis*. *Cannabis* materials for use in the present disclosure may include all parts of the plant such as hurds, fibers, buds, flowers, leaves, seeds and optionally stalk components, or may consist in residues from *Cannabis* extraction. Furthermore, as will be discussed herein, some or all of the THC, CBD, or other soluble components may be extracted from the *Cannabis* during the formation of the reconstituted *Cannabis* material, and the soluble portion that contains for example, THC or CBD may, optionally, be re-applied to the web. Thus, the wrapping material of the present disclosure in one embodiment, is formed from *Cannabis* stalks or hurds, fibers, leaves, seeds, flowers and buds, as well as residues from the *Cannabis* extraction, and thus may generally include all parts of the raw plant material obtained from *Cannabis*.

In one embodiment, the *Cannabis* components are obtained from *Cannabis* plants that have a relatively low THC content. For instance, the amount of THC in the *Cannabis* components can be less than about 1% by weight THC, such as less than about 0.3% by weight THC, such as less than about 0.2% by weight THC, such as less than about 0.1% by weight THC. Using *Cannabis* components from low THC plants can offer various advantages and benefits. Producing a reconstituted *Cannabis* material low in THC, for instance, allows for better control over THC deliveries when the THC is topically applied to the material. In addition, a reconstituted material can be produced that contains no detectable amounts of THC so that the material can deliver other active agents, such as CBD, flavorings, nicotine, or the like. It should be understood, however, that in other embodiments the reconstituted *Cannabis* material can be made from THC containing plants, such as from the species *Cannabis indica*.

As described above, the reconstituted *Cannabis* material of the present disclosure can be produced from various parts of the *Cannabis* plant, including the stalks or hurds, fibers, leaves, seeds, flowers and buds. These different parts of the plant can be combined in different ratios and amounts depending upon the particular application and the desired result. Although the reconstituted *Cannabis* material can be made exclusively from *Cannabis* leaves and stems or can be made exclusively from *Cannabis* buds and flowers, in one embodiment, the reconstituted material is made from a mixture of leaves and hurds combined with buds and/or flowers. For example, in one embodiment, the weight ratio between the leaves and hurds and the buds and/or flowers is from about 1:8 to about 8:1, such as from about 1:5 to about 5:1, such as from about 1:4 to about 4:1, such as from about 2:1 to about 1:2. In one embodiment, the ratio can be about 1:1.

In one embodiment, the reconstituted *Cannabis* material may contain *Cannabis* leaves and hurds in an amount greater than about 10% by weight, such as in an amount greater than about 20% by weight, such as in an amount greater than about 30% by weight, and generally in an amount of up to 100% by weight. Similarly, the reconstituted *Cannabis* material may contain buds and/or flowers in an amount greater than about 10% by weight, such as in an amount greater than about 20% by weight, such as in an amount greater than about 30% by weight, such as in an amount greater than about 40% by weight, such as in an amount greater than about 50% by weight, such as in an amount greater than about 60% by weight, and generally in an amount of up to 100% by weight.

In one aspect, at least a portion of the *Cannabis* components collected for producing the reconstituted *Cannabis* material are *Cannabis* extracted byproducts. *Cannabis* extracted byproducts include *Cannabis* biomass that has already been subjected to a first extraction process for removing desired components from the plant, but without removing substantial amounts of the water soluble components. For example, the *Cannabis* extracted byproducts can be the biomass that remains after one or more cannabinoids have been extracted from the *Cannabis* plant material, such as THC and/or CBD. These types of extraction processes can use different solvents and supercritical fluids. For example, in one embodiment, the extracted byproducts result from a *Cannabis* extraction process in which the *Cannabis* material is ground and combined with a solvent. The solvent, for instance, can be an alcohol, such as ethanol, an organic ester, a petroleum derived hydrocarbon such as toluene or trimethylpentane, or a lipid, such as a vegetable oil. Examples of vegetable oils include safflower oil, coconut oil, and the like. In an alternative embodiment, during the extraction process, the *Cannabis* plant material can be contacted with a supercritical fluid, such as carbon dioxide. In general, the extraction process includes grinding or cutting the plant material to a desired size and then contacting the material with an extractant, such as a solvent or a supercritical fluid. The material can be heated during contact with the solvent. When contacted with a supercritical fluid, for instance, the temperature can be from about 31° C. to about 80° C. and the pressure can be from about 75 bar to about 500 bar.

Using extracted byproducts as a portion of the *Cannabis* components can provide various advantages. For instance, the *Cannabis* extracted byproducts may produce a more mild aerosol and may be in a form that is easier to handle than the virgin plant materials. In order to produce a reconstituted *Cannabis* material, the *Cannabis* extracted byproducts can undergo a second extraction process for removing the water soluble components. The *Cannabis* extracted byproducts, for instance, may contain water soluble components in an amount greater than about 8% by weight, such as in an amount greater than about 12% by weight, such as in an amount greater than about 18% by weight, such as in an amount greater than about 24% by weight, such as in an amount greater than about 28% by weight, and generally in an amount less than about 60% by weight, such as in an amount less than about 50% by weight, such as in an amount less than about 35% by weight.

In forming wrapping materials according to the present disclosure, suitable plant materials are first collected, comminuted to a controlled median particle size, extracted, and fed through a web forming process while being treated by at least one gum. The plant materials used to produce the wrapper can vary depending upon the particular application. In one embodiment, the plant materials comprise *Cannabis* materials. In other embodiments, however, the plant materials can comprise botanicals either alone or in combination with *Cannabis* materials. Botanicals, as used herein, include herbal plants and trees, and various other botanical plants and trees. Particular botanical materials that can be used to produce wrapping materials according to the present disclosure include materials obtained from the cocoa tree, such as cocoa husks, materials obtained from the coffee tree or coffee beans, materials obtained from a tea tree or a tea leaf, including green tea, vines, ginger, ginkgo, chamomile, tomato, ivy, maté, rooibos, cucumber, cordia leaves, mint, cloves, a cereal such as wheat, barley or rye, or other trees such as broadleaved or resinous trees, and mixtures thereof.

*Cannabis* materials and/or botanical materials can also be combined with various tobacco materials. The tobacco materials can be contained, for instance, in the wrapping material in an amount generally less than about 50% by weight, such as in an amount less than about 30% by weight, such as in an amount less than about 10% by weight.

When the wrapping material is made from *Cannabis* materials or botanical materials, the *Cannabis* materials or botanical materials can comprise from about 1% to about 98% by weight of the wrapping material, including all increments of 1% by weight therebetween. For instance, the hemp materials or botanical materials can be present in the wrapping material generally in an amount greater than about 20% by weight, such as in an amount greater than about 30% by weight, such as in an amount greater than about 40% by weight, such as in an amount greater than about 50% by weight, and generally less than about 85% by weight, such as in an amount less than about 75% by weight, such as in an amount less than about 70% by weight. In still another embodiment, the plant material used to produce the wrapping material can be a combination of *Cannabis* materials and botanical materials. The weight ratio between the *Cannabis* materials and botanical materials can be from about 10:1 to about 1:10, such as from about 5:1 to about 1:5, such as from about 2:1 to about 1:2.

Once the plant materials are collected in accordance with the present disclosure, the plant materials are comminuted and subjected to an extraction process for removing water soluble components. Particle reduction can occur first followed by extraction. Alternatively, extraction can occur first followed by particle reduction.

In order to reduce the particle size of the plant materials, any suitable grinding operation, milling operation, refining operation, beating operation, or the like can be used. In addition, various equipment can be combined together such as a shredder in combination with a grinder or hammermill.

In accordance with the present disclosure, the plant materials are comminuted such that the plant material has a median particle size of less than about 120 microns, such as less than about 110 microns, such as less than about 100 microns, such as less than about 90 microns, such as less than about 80 microns, such as less than about 70 microns, such as less than about 60 microns. The median particle size of the plant material is generally greater than about 5 microns, such as greater than about 10 microns, such as greater than about 20 microns. The above particle size ranges have been found particularly well suited to producing wrapping materials with the desired surface characteristics while still preserving tensile strength.

In addition to having a relatively small median particle size, it was discovered that the particle size distribution can be relatively broad while still producing wrapping materials having the desired characteristics. For instance, the plant material can display a D90 particle size of from about 60 microns to about 500 microns. For instance, the D90 particle size can be less than about 450 microns, such as less than about 400 microns, such as less than about 350 microns, such as less than about 300 microns, such as less than about 250 microns, such as less than about 200 microns, such as less than about 150 microns, such as less than about 100 microns. The D90 particle size is generally greater than about 60 microns, such as greater than about 70 microns, such as greater than about 80 microns. The D10 particle size is generally from about 2 microns to about 30 microns, including all increments of 1 micron therebetween. For instance, the D10 particle size can be generally greater than about 3 microns, such as greater than about 5 microns, such as greater than about 6 microns, such as greater than about 8 microns, such as greater than about 10 microns, and generally less than about 60 microns, such as less than about 40 microns, such as less than about 30 microns.

As used herein, particle size can be determined using any suitable laser diffraction particle analyzer. The above sizes are based on a volumetric particle size distribution measurement.

Once reduced in particle size or prior to reducing the particle size, the plant materials can be subjected to a gentle extraction process for removing water soluble components. Specifically, the compounds naturally present in the plant materials that are soluble in the solvent may give rise to problems, such as bonding to the drying cylinders, difficulties in draining or problems of fermentation in the tanks. In one embodiment, the extraction process may include placing the plant materials in water and allowing the water soluble portions to be extracted into the water. In an alternative embodiment, various solvents that are water-miscible, such as alcohols (e.g., ethanol), and/or suitable oils and fats, can be combined with water to form an aqueous solvent. For example, suitable oils and fats may be those in which THC and/or CBD are soluble, in order to extract THC and/or CBD from *Cannabis* materials during the extraction phase. The water content of the aqueous solvent can, in some instances, be greater than 50 wt. % of the solvent, and particularly greater than 90 wt. % of the solvent. Deionized water, distilled water or tap water may be employed. The amount of the solvent in the suspension can vary widely, but is generally added in an amount from about 50 wt. % to about 99 wt. %, in some embodiments from about 60 wt. % to about 95 wt. %, and in some embodiments, from about 75 wt. % to about 90 wt. % of the suspension. However, the amount of solvent can vary with the nature of the solvent, the temperature at which the extraction is to be carried out. In one embodiment, the solvent may be heated. Of course, while a variety of solutions may be used, the extraction solution should also be selected so as to be effective for removing soluble compounds while leaving the plant materials unharmed. In one embodiment, for instance, the extraction solution may be a hot aqueous solution that may include water.

The plant materials in solvent may optionally be agitated by stirring, shaking or otherwise mixing the mixture in order to increase the rate of solubilization. Typically, the process is carried out for about 10 minutes to about 6 hours. Process temperatures may range from about 10° C. to about 100° C., such as from about 40° C. to about 80° C.

After the plant materials are soaked and optionally agitated, the insoluble portion of the plant materials can be mechanically separated from the soluble portion of the plant materials using a press or a centrifuge or otherwise separated from the solvent which now contains the soluble portion of the plant materials. Once the soluble fraction is separated from the insoluble fraction, the soluble fraction can be discarded or further processed, such as by being concentrated. The soluble fraction can be concentrated using any known type of concentrator, such as a vacuum evaporator. In one embodiment of the present disclosure, the soluble fraction can be highly concentrated. In one embodiment, for instance, the soluble fraction can be evaporated so as to have a final brix or dry matter of from about 10% to about 60%, such as from about 20% to about 40%, such as from about 25% to about 35%.

While the extraction process removes soluble compounds in order to facilitate the processing of the wrapping material, the extraction process can also be used to remove other undesired compounds. For instance, through the extraction process, pesticides and other compounds may be removed from the plant materials in the soluble portion, and then may be further eliminated from the soluble portion prior to the optional concentration of the soluble portion.

The resulting concentrated soluble fraction may be discarded, used in a separate process, or can be later applied onto the wrapping material of the present disclosure as will be described in greater detail below.

The resulting water insoluble plant fraction is generally in an unrefined state. The plant material can comprise particles and fibers. In one embodiment, the insoluble and extracted plant fraction can be subjected to a refining process. For instance, the extracted plant material can be fed through any suitable refining device, such as a conical refiner or a disks refiner. Other refining devices that may be used include a beater, such as a Valley beater. Refining can occur while the plant materials are moist or after being combined with water. For instance, in one embodiment, refining can occur while the plant material is at a consistency of less than about 10%, such as less than about 5%, such as less than about 3%.

The amount the plant material and/or fibers are refined can vary depending upon the particular application. In one embodiment, the degree of refining can be from about 60° SR to about 110° SR including all increments of 1° SR therebetween. For instance, the degree of refining can be less than about 100° SR, such as less than about 90° SR, such as less than about 80° SR. The degree of refining is generally greater than about 60° SR, such as greater than about 70° SR, such as greater than about 80° SR.

The extracted plant material can be optionally combined with web building fibers in forming a fiber substrate. For example, the extracted plant material can be combined with water or an aqueous solution to form a slurry. The web building fibers, such as delignified cellulosic fibers, can be combined with the plant material in forming the slurry. The fiber slurry is then used to form a continuous reconstituted sheet or web. For example, in one embodiment, the fiber slurry is fed to a papermaking process that can include a forming wire, gravity drain, suction drain, a felt press, and a dryer, such as a Yankee dryer, a drum dryer, or the like. Similarly, in one embodiment, the fiber slurry is formed into a continuous sheet on a Fourdrinier table.

As described above, the wrapping material of the present disclosure also contains at least one gum. Various different gums can be used in accordance with the present disclosure. In one embodiment, for instance, arabic gum is used. Other gums well suited for use in producing the wrapping material of the present disclosure include alginates, guar gum, pectin, polyvinyl alcohol, polyvinyl acetate, cellulose derivates such as ethylcellulose, methylcellulose, and carboxymethylcellulose, starch, starch derivatives, and the like. In addition, a combination of gums can be used. For instance, arabic gum can be combined with an alginate and/or a starch. An alginate can also be combined with a starch. An alginate is a derivative of an acidic polysaccharide or gum which occurs as the insoluble mixed calcium, sodium, potassium, and magnesium salt in the Phaeophyceae brown seaweeds. Alginates include calcium, sodium, potassium, and/or magnesium salts of high molecular weight polysaccharides composed of varying proportions of D-mannuronic acid and L-guluronic acid. Exemplary alginates include ammonium alginate, potassium alginate, sodium alginate, propylene glycol alginate, and/or mixtures thereof.

Gums can be added to the wrapping material at one point in producing the web or can be applied at multiple locations. In one embodiment, one or more gums can be combined with the fiber furnish used to form the nonwoven web. For instance, a gum, such as arabic gum, can be added to the fiber slurry such that the resulting wrapping material contains the one or more gums in an amount greater than about 0.5% by weight, such as in an amount greater than about 1% by weight, such as in an amount greater than about 1.5% by weight, and generally in an amount less than about 5% by weight, such as in an amount less than about 3% by weight, such as in an amount less than about 2.5% by weight.

In one embodiment, the fiber slurry is laid onto a porous forming surface and formed into a sheet. Excess water is removed by a gravity drain and/or a suction drain. In addition, various presses can be used to facilitate water removal. The formed sheet can be dried and further treated.

Optionally, the wrapping material that is produced can also be treated with the soluble extract portion, such as a concentrated soluble plant portion that was separated from the insoluble fraction. The soluble portion can be applied to the web using various application methods, such as sizing, coating etc. The amount of water soluble extracts applied to the reconstituted material can depend upon various factors and the anticipated end use application. For example, the soluble plant extracts can be applied to the wrapping material in an amount insufficient to adversely interfere with the inherent taste of the underlying material. For instance, in one embodiment, the water soluble plant extracts are applied to the reconstituted material such that the reconstituted material contains water soluble plant extracts, such as *Cannabis* extracts, in an amount greater than about 5% by weight, such as in an amount greater than about 10% by weight, such as in an amount greater than about 15% by weight, such as in an amount greater than about 20% by weight, such as in an amount greater than about 25% by weight, such as in an amount greater than about 30% by weight, and generally in an amount less than about 55% by weight, such as in an amount less than about 50% by weight, such as in an amount less than about 45% by weight, such as in an amount less than about 40% by weight, such as in an amount less than about 35% by weight. When the extract is not reapplied to the fibrous web or only applied in small amounts, the resulting wrapping material can contain water soluble components generally in an amount less than about 30% by weight, such as in an amount less than about 20% by weight, such as in an amount less than about 10% by weight, such as in an amount less than about 8% by weight.

As described above, web building fibers can be incorporated into the wrapping material and combined with the extracted plant material having a relatively low median particle size. The web building fibers can comprise delignified fibers, such as delignified cellulosic fibers.

Cellulosic fibers that may be used include wood pulp fibers such as softwood fibers or hardwood fibers, flax fibers, abaca fibers, bamboo fibers, coconut fibers, cotton fibers, kapok fibers, ramie fibers, jute fibers, other bast fibers, or mixtures thereof. In one particular embodiment, the reconstituted plant material contains hemp pulp fibers alone or in combination with other fibers such as softwood fibers or flax fibers, or the like.

The web building fibers can have an average fiber length of generally greater than about 0.5 mm, such as greater than about 1 mm, such as greater than about 1.5 mm, such as greater than about 1.8 mm, and generally less than about 4 mm, such as less than about 3 mm, such as less than about 2.5 mm, such as less than about 2.35 mm.

The web or wrapping material may include the web building fibers in an amount of from about 0% to about 80% by weight, such as from about 5% to about 60%, such as from about 10% to about 50%, such as from about 15% to about 40% web building fibers by weight based upon the weight of the wrapping material or web, or any ranges therebetween.

During formation of the fibrous web or after the fibrous web has been formed, one or more gums can be applied to the web. In one embodiment, for instance, one or more gums can be applied to the web using, for instance, a size press. The size press can be used to apply one or more gums to the web while the web is still wet or after drying. When applied using a size press, in one embodiment, the one or more gums can become impregnated into the web. In one embodiment, an arabic gum can be applied to the web using a size press.

In an alternative embodiment, one or more gums can be printed onto the web after the web has been dried. Any suitable printing device can be used to apply the one or more gums to a surface of the web. For instance, the one or more gums can be applied to the web using gravure printing, digital printing, or the like.

As described above, one or more gums can be applied in forming the wrapping material by (1) being combined with the fiber furnish used to form the web; (2) being applied during the papermaking process using, for instance, a size press; and/or (3) being applied to a surface of the dried web using, for instance, printing. One or more gums can be incorporated into the wrapping material using one of the above processes or all three of the above described techniques. In one embodiment, for instance, a gum is added to the fiber furnish to form the web and then applied using a size press. In another embodiment, a gum is applied to the fiber furnish to form the web, a gum is applied using the size press, and then a gum is printed onto a surface of the web.

The amount of one or more gums incorporated into the wrapping material can vary depending upon the particular application and the desired result. The amount of gum applied to the web can also depend upon the types of fibers used to form the web and the type of gum used. In general, one or more gums can be incorporated into the wrapping material in an amount greater than about 2% by weight, such as in an amount greater than about 5% by weight, such as in an amount greater than about 10% by weight, such as in an amount greater than about 15% by weight, such as in an amount greater than about 20% by weight, such as in an amount greater than about 25% by weight, and generally in an amount less than about 50% by weight, such as in an amount less than about 45% by weight, such as in an amount less than about 40% by weight, such as in an amount less than about 35% by weight. In one particular embodiment, a web is produced having a basis weight of from about 35 gsm to about 50 gsm and one or more gums are applied to the web so that the resulting total basis weight of the wrapping material is from about 42 gsm to about 75 gsm, such as from about 55 gsm to about 65 gsm. The above is only provided for exemplary purposes and it should be understood that the basis weight of wrapping materials made according to the present disclosure can have wide variability.

In addition to one or more gums, various other liquid components can be applied to the wrapping material during its formation. For instance, in one embodiment, one or more gums can be combined with a humectant for applying to the fibrous web. The humectant can be combined with one or more gums in the size press and/or can be combined with one or more gums during a printing process. Alternatively, one or more humectants can be applied to the fibrous web independently of the one or more gums.

Humectants that can be applied to the wrapping material include a polyol, a non-polyol, or mixtures thereof. Particular humectants include sorbitol, glycerol, propylene glycol, triethylene glycol, or a mixture thereof. Non-polyol humectants include lactic acid, glyceryl diacetate, glyceryl triacetate, triethyl citrate, isopropyl myristate, or mixtures thereof. One or more humectants can be applied to the wrapping material in an amount generally from about 0.1% to about 30% by weight, including all increments of 0.5% by weight therebetween. In one embodiment, relatively lower amounts of humectants are incorporated into the wrapping material. In this embodiment, one or more humectants can be present in the wrapping material in an amount greater than about 1% by weight, such as in an amount greater than about 2% by weight, and generally in an amount less than about 8% by weight, such as in an amount less than about 5% by weight, such as in an amount less than about 4% by weight. In other embodiments, greater amounts of humectants can be applied to the wrapping material. For instance, one or more humectants can be applied in an amount greater than about 8% by weight, such as in an amount greater than about 12% by weight, such as in an amount greater than about 15% by weight, such as in an amount greater than about 20% by weight, and generally in an amount less than about 35% by weight, such as in an amount less than about 25% by weight.

Wrapping materials according to the present disclosure have good strength, smoothness, adjustable basis weight, and adjustable permeability. Thus, a wrapping material according to the present disclosure may be able to withstand a papermaking process as well as the mechanical stress of mass production of smoking articles and may also have good sensory characteristics and burn properties. Furthermore, as will be discussed in greater detail below, it was also found that the wrapping material functions well as a carrier for other taste or aerosol delivery compositions.

In general, the wrapping material can have a basis weight of greater than about 20 gsm, such as greater than about 30 gsm, such as greater than about 40 gsm, such as greater than about 50 gsm, such as greater than about 60, gsm, such as greater than about 70 gsm, such as greater than about 80 gsm, such as greater than about 85 gsm. The basis weight of the wrapping material is generally less than about 120 gsm, such as less than about 100 gsm, such as less than about 90 gsm, such as less than about 80 gsm, such as less than about 70 gsm, or any ranges therebetween. Within the above basis weights, the wrapping material is very strong and can exhibit a tensile strength of greater than about 1,000 cN/15 mm, such as greater than about 1,500 cN/15 mm and generally less than about 5,000 cN/15 mm. Tensile strength can be measured using ASTM Test D828-97.

The wrapping material according to the present disclosure may also have a permeability that facilitates suitable smoking properties, such as good mainstream smoke control or good smoking comfort. For instance, the wrapping material according to the present disclosure may have a permeability measured in Coresta units of from about 0 Coresta to about 100 Coresta, such as from about 0 Coresta to about 90 Coresta, such as from about 0 Coresta to about 80 Coresta, such as from about 3 Coresta to about 60 Coresta, or any ranges therebetween. In one embodiment, the wrapping material can have a relatively low permeability. For instance, the permeability can be less than about 25 Coresta, such as less than about 20 Coresta, such as less than about 15 Coresta, such as less than about 10 Coresta, such as less than about 8 Coresta, such as less than about 5 Coresta, such as less than about 4 Coresta, such as less than about 3 Coresta.

While the wrapping material according to the present disclosure may naturally or inherently have a desired permeability, in one embodiment, it may be desirable to also perforate the wrapping material after formation. Perforation may be performed as known in the art, and the number and size of the perforations may be selected as needed for the desired application.

In addition to the above physical properties, the wrapping material made in accordance with the present disclosure can exhibit a distinct natural appearance with natural speckling and/or coloration from the one or more *Cannabis* fibers or particles. Optionally, the wrapping material may be formulated with pigments (natural or synthetic) to adjust its final coloration.

The wrapping material of the present disclosure may also be used to produce smoking articles having excellent taste and sensory properties. For instance, the wrapping material of the present disclosure produces a less papery taste than conventional smoking papers. Instead, a pleasant neutral or distinct, natural *Cannabis* or botanical taste has been observed, even when the wrapping material contains cellulosic web building fibers.

While the wrapping material may have a suitable taste and burn properties, as discussed above, the wrapping material is a good carrier for other aerosol delivery agents, such as topical additives which may include flavorings, active ingredients, oils, and extracts. For instance, one example of a topical additive may be the soluble portion of the extracted *Cannabis* materials, which may be optionally concentrated, may be re-applied to the wrapping material after formation of the web to impart further taste and smoke characteristics.

In order to incorporate an aerosol delivery agent into the wrapping material of the present disclosure, in one embodiment, an aerosol delivery composition can be formulated containing one or more aerosol delivery agents that is then applied to the wrapper by spraying, using a size press, printing, or the like. The aerosol delivery composition can be combined with the gum in being applied to the fibrous web or can be applied independently of the gum. Aerosol delivery compositions that can be applied to the wrapping material of the present disclosure include solutions, suspensions, oils, and the like. Solutions and suspensions, for instance, can be applied to the wrapping material and later dried leaving behind a solid residue within the fiber substrate.

In one embodiment, an aerosol delivery composition may be obtained by extracting a plant substance from a plant for application to the wrapping material. Additionally or alternatively, the present disclosure may include a step for isolating at least one compound from a plant substance, concentrating a plant substance, or even purifying or eliminating a compound from a plant substance, in order to obtain a modified plant substance to be applied to the wrapping material. While optional, such a process may result in the transformation of an original raw plant substance into a modified plant substance, whether in the form of dry extracts, liquid extract, a liquor or an isolated substance, based upon the desired end properties of the plant substance to be applied to the wrapping material. Of course, while the plant substance may be an original plant substance or a modified plant substance, in one embodiment, the plant substance is applied to the wrapping material without undergoing any further processing after extraction. Furthermore, while the aerosol delivery composition has been described as being extracted from a plant, it should be understood that synthetic or naturally occurring aerosol delivery compositions (e.g. without needing to be extracted) may also be used.

Examples of aerosol delivery agents that may be contained in the aerosol delivery composition include, or may be an extract of, nicotine, sugars, licorice extracts, menthol, honey, coffee extracts, maple syrup, tobacco extracts, botanical extracts, plant extracts, tea extracts, fruit extracts, flavorings such as clove, anise, cinnamon, sandalwood, geranium, rose oil, vanilla, caramel, cocoa, lemon oil, cassia, spearmint, fennel, or ginger, fragrances or aromas such as cocoa, vanilla, and caramel, medicinal plants, vegetables, spices, roots, berries, bar, seeks, essential oils and extracts thereof, such as anise oil, clove oil, carvone and the like, artificial flavoring and fragrance materials such as vanillin, and mixtures thereof. The extracts applied to the wrapping material can be water soluble or water dispersible. Thus, various different carrier liquids can be used to apply the aerosol delivery agents to the wrapping material.

In one embodiment, the wrapping material of the present disclosure can be used as a carrier for components obtained from *Cannabis*. *Cannabis*, for instance, has recently been legalized in many states in the United States for both medical and recreational use. In addition, various chemicals and compounds contained in *Cannabis* are becoming more and more popular drugs for pain relief in lieu of conventional pain relief medicines, such as opioids. *Cannabis*, for instance, contains various cannabinoids that can be used for pain relief. Inhaling an aerosol created by *Cannabis* is the most common and least expensive method for delivering drugs contained in *Cannabis* to a user. Unfortunately, however, merely inhaling aerosol generated from dried *Cannabis* buds or leaves can lead to non-uniform deliveries of the pain relief drugs contained in the plant. Deliveries of the cannabinoids, for instance, can vary dramatically depending upon the particular plant and the particular plant parts being used to generate the aerosol. In addition, cannabinoid deliveries can vary dramatically based upon other factors such as the packing density of the material, the particular type of aerosol-generating device or smoking article used to produce an aerosol, and the like. In addition, aerosols created from *Cannabis* plant can contain irritants and produce a relatively harsh aerosol or smoke. For instance, the aerosol generated from the wrapping material of the present disclosure is non-irritating, and has a neutral taste. Cannabinoids that can be incorporated into the wrapping material of the present disclosure include cannabidiol (CBD) and tetrahydrocannabinol (THC). THC contained in *Cannabis* acts on specific receptors in the brain which lead to a feeling of euphoria and a relaxed state. CBD, on the other hand, also interacts with pain receptors in the brain but does not create the same euphoric feeling caused by THC. In accordance with the present disclosure, in one embodiment, THC can be applied to the wrapping material of the present disclosure, CBD can be applied to the wrapping material or, alternatively, both THC and CBD can be applied to the wrapping material.

In addition to THC and CBD, various other cannabinoids can also be incorporated into an aerosol delivery composition and applied to the wrapping material in accordance with the present disclosure. For instance, other cannabinoids contained in *Cannabis* include cannabichromene, cannabinol, cannabigerol, tetrahydrocannabivarin, cannabidivarin, cannabidiolic acid, other cannabidiol derivatives, and other tetrahydrocannabinol derivatives. The above cannabinoids can be used singularly or in any combination and applied to the wrapping material.

The cannabinoids described above can be applied to the wrapping material using various different methods. For instance, in one embodiment, the cannabinoid, such as CBD, can be formulated into a water soluble form or powder that can be applied to the wrapping material as a solution or aqueous suspension. Alternatively, a *Cannabis* oil extract may be obtained from raw *Cannabis* plants. The oil extract may contain THC alone, CBD alone, or a combination of THC and CBD. The oil extract can be applied to the wrapping material so that an aerosol generated by the material contains controlled amounts of the cannabinoids. In addition to containing controlled amounts of the cannabinoids, the wrapping material can also be designed to provide uniform deliveries of the cannabinoids in the aerosol generated from the material.

Another component that can be added to the reconstituted plant material are various flavorants, especially terpenes. A terpene or a blend of terpenes, for instance, can be used to develop desirable aromas and indicate to the user the quality of the product. One or more terpenes can also improve the sensory reaction to inhaling an aerosol created by the reconstituted material.

Various different terpenes can be applied to the reconstituted plant material. Such terpenes include but are not limited to pinene, humulene, b-caryophyllene, isopulegol, guaiol, nerylacetate, neomenthylacetate, limonene, menthone, dihydrojasmone, terpinolene, menthol, phellandrene, terpinene, geranylacetate, ocimene, myrcene, 1,4-cineole, 3-carene, linalool, menthofuran, perillyalcohol, pinane, neomenthylaceta, alpha-bisabolol, borneol, camphene, camphor, caryophyllene oxide, alpha-cedrene, beta-eudesmol, fenchol, geraniol, isoborneol, nerol, sabinene, alpha-terpineol, and mixtures thereof.

In one embodiment, various different terpenes can be blended together in order to mimic the ratios of terpenes found in natural *Cannabis* plants. For instance, from about 2 to about 12 terpenes can be blended together and applied to the reconstituted plant material. Each terpene can be applied to the reconstituted plant material in an amount greater than about 0.001% by weight and generally less than about 2% by weight. For instance, each terpene can be applied in an amount from about 0.01% by weight to about 1.5% by weight. For instance, each terpene can be applied in an amount from about 0.1% to about 1.1% by weight.

Exemplary blends of terpenes include alpha-pinene, beta-caryophyllene, and beta-pinene; alpha-humulene, alpha-pinene, beta-caryophyllene, beta-pinene, and guaiol; beta-caryophyllene, beta-pinene, and d-limonene; beta-caryophyllene, beta-pinene, and nerolidol; beta-caryophyllene, beta-pinene, d-limonene, and terpinolene; alpha-bisabolol, alpha-pinene, beta-caryophyllene, beta-myrcene, beta-pinena, and d-limonene; beta-caryophyllene, beta-pinena, and p-cymene; alpha-humulene, beta-caryophyllene, beta-pinene, d-limonene, linalool, and nerolidol; beta-caryophyllene and beta-pinene; beta-caryophyllene, beta-myrcene, and terpinolene; alpha-pinene, beta-caryophyllene, beta-pinene, d-limonene; alpha-humulene, alpha-pinene, beta-caryophyllene, beta-myrcene, beta-pinena, d-limonene, and guaiol.

The aerosol delivery composition and agent may be contained in the wrapping material in an amount greater than about 0.1% by weight, such as at least about 1% or greater, such as at least about 5% or greater, such as at least about 10% or greater, such as at least about 15% or greater, such as at least about 20% or greater, such as at least about 25% or greater, such as at least about 30% or greater, such as at least about 35% or greater, such as 40% or less, or any ranges therebetween.

Wrapping materials made according to the present disclosure can be incorporated into all different types of smoking articles and aerosol-generating materials. In addition to ignited products, the wrapping materials can be used in heat but not burn products. In heat but not burn applications, the wrapping material surrounds a column of an aerosol-generating filler that produces a vapor when heated but not ignited.

Figure 2:
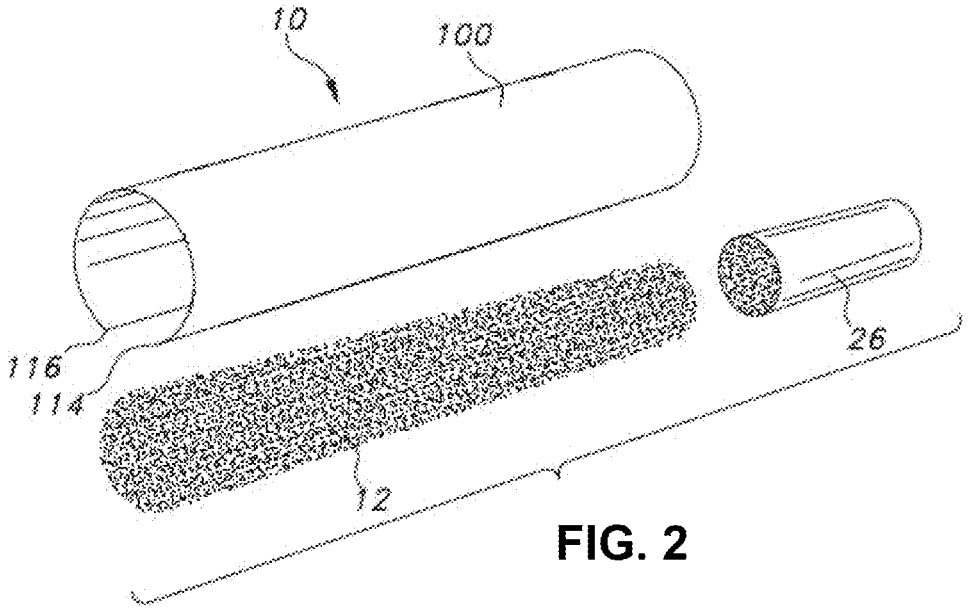
FIG. 2 is an exploded view of the smoking article illustrated in FIG. 1.

For illustrative purposes only, one such smoking article is shown in FIGS. 1 and 2. As shown, the smoking article 10 includes a smokable column 12. The smoking article 10 may also include a wrapping material 100 that defines an outer circumferential surface 16 when wrapped around the smokable column 12. The article 10 may optionally include a filter 26 that may be enclosed by a tipping paper, however, depending upon the smokable column material, a filter may be optional or omitted.

The smokable column 12 can be made from any suitable filler material capable of producing an aerosol when heated. In one embodiment, the smokable column 12 is comprised of *Cannabis* materials. Alternatively, the smokable column 12 can be comprised of tobacco materials alone or in combination with *Cannabis* materials. The smokable column 12 can also comprise a botanical blend alone or combined with *Cannabis* and/or tobacco. In one embodiment, the wrapping material 100 and the smokable column 12 can both be nicotine-free for producing a nicotine-free aerosol generating product.

The smoking article shown in FIGS. 1 and 2 generally comprises a *Cannabis* or tobacco cigarette. In other embodiments, however, the wrapping material of the present disclosure can be used to produce other *Cannabis* and *Cannabis* products (including heat but not burn products), as well as herbal cigarettes, cigarillos, and little cigars, or pre-rolled cones or even conventional tobacco smoking articles. While not shown, a cigarillo, for example, can include a plastic tip.

Figure 3A:
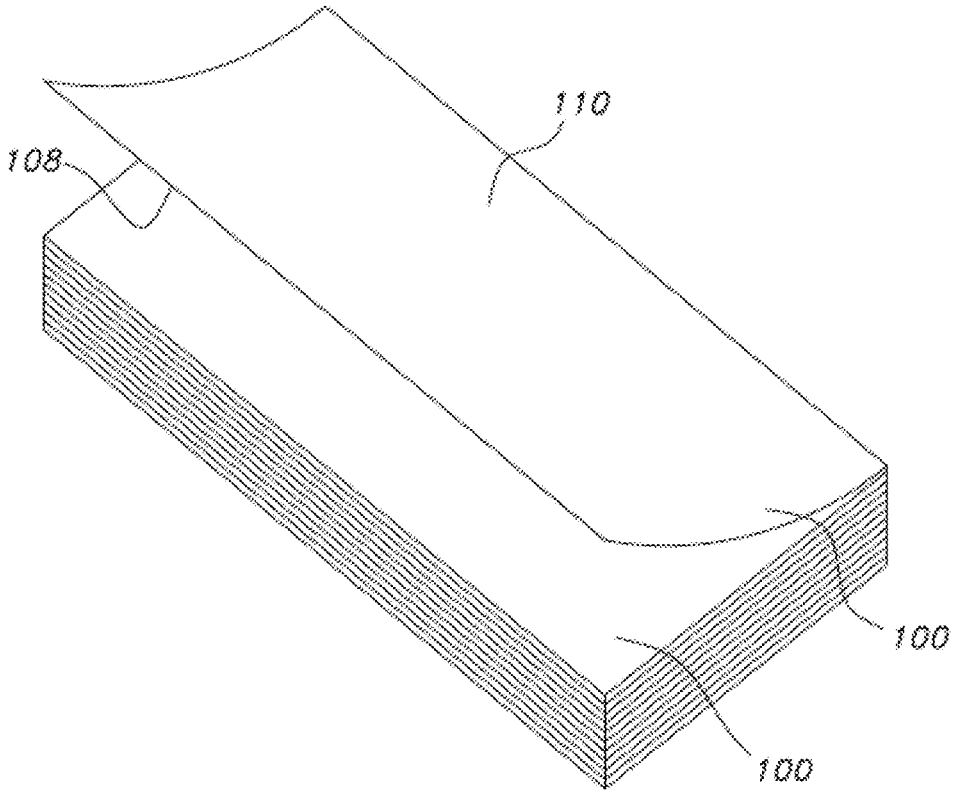
FIG. 3A illustrates an article according to the present disclosure.

Notwithstanding the articles that may utilize a wrapping material 100 according to the present disclosure, FIG. 3*a* shows an embodiment of the present disclosure wherein the wrapping material 100 is formulated as a booklet of individual wrapping materials 100 affixed to one or more adjacent wrapping materials 100 via a natural, or at least smokable or edible, adhesive 104. The adhesive 104, for instance, can comprise the gum incorporated into the wrapping material according to the present disclosure. Alternatively, the adhesive 104 can comprise the gum combined with other materials for improving the adhesive properties.

Figure 3B:
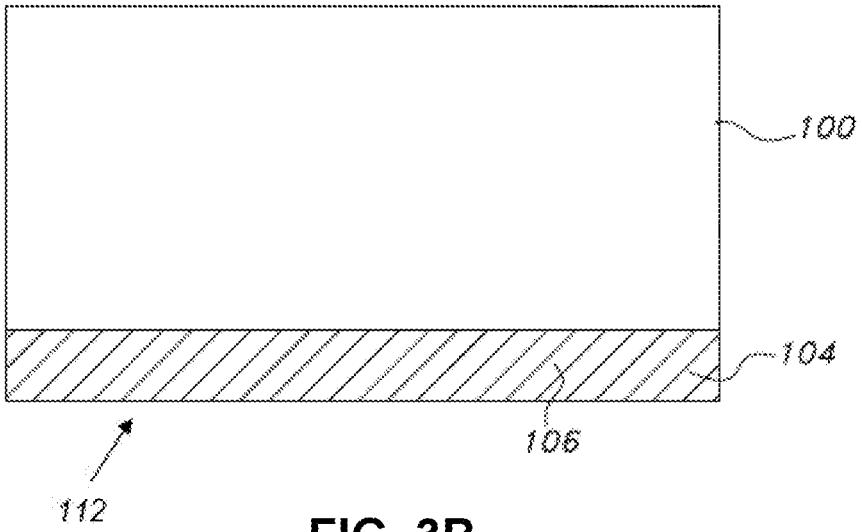
FIG. 3B illustrates a single piece of the article of FIG. 3*a*.

As shown in FIG. 3*b*, in one embodiment, the adhesive 104 may only be located on a portion of the wrapping material 100, such as on an edge 106 thereof. Additionally or alternatively, the adhesive may only be located on a first side 108, which is opposite a second side 110. In such an embodiment, the first side 108 of a first wrapping material 100 may have an adhesive 104 located thereon, and may be oriented so as to be placed in contact with a second side 110 of an adjacent piece of wrapping material 100. As such, each piece of wrapping material 100 may have adhesive on a single side, so as to adhere to an immediately adjacent piece of wrapping material 100 or to a backing material 112. However, it should be understood that, in an alternative embodiment, the adhesive 104 may be located on both sides, 108 and 110, or on one or more portions of either side 108 and 110.

Regardless of the manner in which the adhesive is applied, the adhesive may be selected to be "releasable" and then "resealable" in that the adhesive may serve to releasably affix a piece of wrapping material 100 to an adjacent piece of wrapping material 100, until such a time as a user wishes to remove a piece of wrapping material 100 from an adjacent piece of wrapping material. At such a point, the adhesive 104 may retain its adherence properties, and may serve to adhere to a portion of the wrapping material 100 to which the adhesive 104 has been applied, such as, for example, referring to FIG. 2, the adhesive 104 may adhere a first edge 114, or an area of the wrapping material adjacent to the first edge 114, of the wrapping material 100 to a second edge 116, or area of the wrapping material adjacent to the second edge 116, when forming a smokable article. Of course, the adhesive 104 may also be used to attach the wrapping material 100 to a second piece of wrapping material 100, or to any portion on either side of the wrapping material 100 to which the adhesive 104 has been applied. For instance, an embodiment where an adhesive 104 may be utilized or desired, is for hand-rolled smoking articles.

While additives may not be necessary in the wrapping material, as the wrapping material according to the present disclosure naturally has good manufacturing properties (e.g. tensile strength) and sensory properties, generally, a wrapping material according to the present disclosure may include one or more additives. Additives may be used for manufacturing wrapping papers so as to develop or give the wrapping material new properties, for instance chemical, optical, sensory or mechanical properties such as tear strength or folding resistance. In one embodiment, an additive may be fillers, burn control additives, wet strength agent, an oil-barrier and fat-barrier agent, an antiblocking agent, a dry strength agent, a preservative, a softener, a wetting agent or lattices.

For example, the wrapping material of the present disclosure may optionally contain a filler. The filler can comprise particles incorporated into the reconstituted web material for any desired purpose, such as for facilitating formation of the wrapping material and/or for affecting the appearance or strength of the material. Fillers may include kaolin clay, magnesium oxide, calcium carbonate, or a mixture thereof.

The amount of filler in the wrapping material according to the invention is from 0% to 40%, preferably from 5% to 20%, even more preferentially from 10% to 20% by weight of the wrapping material.

In one embodiment, the particle size of the filler may be carefully controlled such that the average particle size of the filler is from about 10 microns or less, such as about 7.5 microns or less, such as from about 5 microns or less, and may also be about 0.1 microns or greater. Of course, in an alternative embodiment, the particle size may be more varied based upon the desired characteristics to be obtained from the filler.

The burn control agent, for instance, may comprise a salt of a carboxylic acid. For example, the burn control agent may comprise an alkali metal salt of a carboxylic acid, an alkaline earth metal salt of a carboxylic acid, or mixtures thereof. Examples of burn control agents that may be used include a salt of acetic acid, citric acid, malic acid, lactic acid, tartaric acid, carbonic acid, formic acid, propionic acid, glycolic acid, fumaric acid, oxalic acid, malonic acid, succinic acid, nitric acid, phosphoric acid, or mixtures thereof. Particular burn controlling agents that may be used include potassium citrate, sodium citrate, potassium succinate, sodium succinate, or mixtures thereof. When present, the burn control agent can be applied to the wrapping material generally in an amount greater than about 0.1% by weight, such as in an amount greater than about 0.5% by weight, such as in an amount greater than about 1% by weight and generally less than about 5% by weight, such as less than about 4% by weight, such as less than about 3% by weight, such as less than about 2% by weight.

A wet strength agent may reduce the potential for degradation of the wrapping material if the latter is placed in contact with a liquid, such as water. Typically, the wet strength agent may be chosen from polyamides, such as epichlorohydrin resin, a polyamine-epichlorohydrin resin, a poly(aminoamide)-epichlorohydrin resin, a urea-formaldehyde resin, a melamine-formaldehyde resin; an alkyl-ketene dimer; alkylsuccinic anhydride; a polyvinylamine; an oxidized polysaccharide. Typically, the amount of wet strength agent is from 0.1% to 30%, preferably from 1% to 15%, even more preferentially from 5% to 10% by dry weight of the wrapping material.

An oil-barrier and fat-barrier agent may reduce the absorption of fats by the paper. Typically, the oil-barrier and fat-barrier agent may be chosen from carboxymethylcellulose, polyacrylamides, acrylic esters and latices.

An antiblocking agent may limit the adhesion of a material to the paper. Typically, the antiblocking agent may be chosen from carboxymethylcellulose, polyacrylamides, acrylic esters, silicones and latices.

A dry strength agent may increase the resistance of the wrapping material if the latter is subjected to large mechanical stresses. The dry strength agent may be chosen from starches and modified gums, cellulose polymers, synthetic polymers, for instance carboxymethylcellulose and polyacrylamides. Typically, the amount of dry strength agent is from 0.1% to 15%, preferably from 1% to 10%, even more preferentially from 1% to 5% by dry weight of the wrapping material.

A softener may improve the softness of the wrapping material. Typically, a softener is a fatty acid, a siloxane compound, a silicone compound, an aminosilicone compound, an extract of aloe vera, an extract of sweet almond, an extract of camomile, a quaternary ammonium compound. Typically, the amount of softener is from 0.1% to 30%, preferably from 1% to 15%, even more preferentially from 5% to 10% by dry weight of the wrapping material.

The finished web or wrapper is dried and wound into rolls. For instance, in one embodiment, the dried sheet is wound into bobbins having a desired width. The width can be the width of the paper machine. In one aspect, the width can be from about 15 mm to about 500 mm, such as from about 20 mm to about 300 mm. Prior to winding the web into a bobbin, the web may be calendered to increase the smoothness and runnability of the material. In one embodiment, for instance, a multi-nip calendar device may be used.

In one embodiment, the wrapping material of the present disclosure can be cut into individual sheets and sold in a package to consumers in order to produce roll-your-own products.

The present disclosure may be better understood with reference to the following examples.

EXAMPLES

Various wrapping materials were made in accordance with the present disclosure. In this example, all of the wrapping materials were made containing hemp fiber biomass combined with hemp pulp fibers.

More particularly, post-extracted hemp raw material comprised of leaves, flowers, and stems was ground using a lab scale grinder (Thomas-Wiley Mill Model 4). The *Cannabis* material was passed through the grinder three times in order to achieve a median particle size of less than about 60 microns. Other samples of the *Cannabis* material were comminuted by a third party. The following samples were produced having the following particle size distribution. Particle size was measured using a laser diffraction particle analyzer. In particular, a portion of each sample was added into the chamber of the analyzer and dispersed throughout an optical laser window. The analyzer took three measurements from each sample and the following are the average results.

| | Size Distribution (μm) | | |
|---|---|---|---|
| Sample No. | D(10) | D(50) | D(90) |
| 1 | 4.05 | 20.62 | 66.20 |
| 2 | 4.06 | 21.43 | 68.45 |
| 3 | 4.00 | 20.39 | 64.74 |
| 4 | 7.57 | 43.30 | 372.00 |
| 5 | 7.72 | 42.74 | 369.30 |
| 6 | 7.56 | 43.49 | 399.50 |
| 7 | 5.64 | 24.36 | 74.11 |
| 8 | 5.64 | 24.59 | 75.17 |
| 9 | 5.87 | 24.14 | 75.66 |
| 10 | 5.11 | 22.12 | 71.84 |
| 11 | 5.11 | 22.19 | 72.64 |
| 12 | 5.14 | 22.27 | 73.80 |

The above data represents volumetric particle size distribution measurements. As shown, each of the samples had a median particle size of from about 20 microns to about 44 microns. The D90 particle sizes varied from 64 microns to about 400 microns.

For each of the above samples, 300 grams of the grinded *Cannabis* material was placed in a mesh bag and placed into a beaker containing 1500 mL of water. The beaker and its contents were placed in a temperature controlled hot water bath at 70° C. for 20 minutes. After 20 minutes, the beaker was removed and the raw material was placed in a press to allow complete separation of the water soluble components from the insoluble components.

A second extraction took place for 10 minutes at 70° C. and the water soluble components were once again removed.

The extractables from both extractions were combined and concentrated.

The extracted *Cannabis* material was then mixed with 147.8 grams of pre-hydrated hemp pulp fibers using an agitator. Once the mixture was uniform, it was passed through a refiner multiple times until a desired degree of refining was achieved. The degree of refining was from about 8° SR to about 90° SR. A 2% arabic gum solution was then added to the fiber slurry and was mixed for 5 minutes.

The fiber slurry was then used to make a handsheet having a basis weight of about 42 gsm. The base sheet was then coated using a size press with the concentrated extractant that was mixed with 9% arabic gum and 3% glycerin. A smooth and strong sheet was produced having a basis weight of about 60 gsm and a porosity value of about 0. The gum mixture applied to the wrapper was found to provide a self-adhesive property.

All of the samples tested produced wrapping materials having the look and feel of a cast sheet. The wrappers, however, were very strong and had an extremely smooth surface. The self-adhesive properties of the wrapper were also enhanced.

Sample Nos. 4-6 which had relatively larger particles were found to produce excellent wrapping materials. This may indicate that, as long as the median particle size is relatively low, a relatively large particle size distribution can be used to produce the wrapping materials.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A wrapping material for a smoking article comprising:

a web comprising an extracted plant material comprising *cannabis* leaves, *cannabis* stems, *cannabis* buds, *cannabis* flowers, or by-products from *cannabis* extraction, or mixtures thereof, the plant material having a median particle size of less than about 80 microns, the web having been treated with a gum.

2. A wrapping material as defined in claim 1, wherein the extracted plant material has a D90 particle size of from about 60 microns to about 500 microns.

3. A wrapping material as defined in claim 1, wherein the extracted plant material has a median particle size of from about 15 microns to about 80 microns.

4. A wrapping material as defined in claim 1, further comprising web building fibers.

5. A wrapping material as defined in claim 1, wherein the gum comprises arabic gum.

6. A wrapping material as defined in claim 1, wherein the gum comprises guar gum, alginate, a cellulose derivative, or mixtures thereof.

7. A wrapping material as defined in claim 1, wherein the gum has been applied to a first side of the web or applied to a first side of the web and to an opposite second side of the web.

8. A wrapping material as defined in claim 7, wherein the gum has also been incorporated into the web during formation.

9. A wrapping material as defined in claim 7, wherein a humectant has also been applied to the first side of the web or applied to the first side of the web and to the opposite second side of the web.

10. A wrapping material as defined in claim 1, wherein the web has a basis weight of from about 20 gsm to about 150 gsm.

11. A wrapping material as defined in claim 4, wherein the web building fibers comprise delignified cellulosic fibers.

12. A wrapping material as defined in claim 4, wherein the web building fibers comprise hemp pulp fibers.

13. A wrapping material as defined in claim 4, wherein the web includes from about 1% to about 50% by weight web building fibers.

14. A wrapping material as defined in claim 1, wherein the web is formed from a *cannabis* material containing less than 0.3% by weight tetrahydrocannabinol.

15. A wrapping material as defined in claim 1, wherein the extracted plant material contained in the web has been refined in an amount of greater than about 5° SR and less than about 90° SR.

16. A wrapping material as defined in claim 1, wherein the web has a permeability of less than about 20 Coresta.

17. A wrapping material as defined in claim 1, further comprising an aerosol delivery composition, the aerosol delivery composition containing an aerosol delivery agent.

18. A wrapping material as defined in claim 17, wherein the aerosol delivery agent comprises tetrahydrocannabinol, a cannabidiol or mixtures thereof.

19. A wrapping material as defined in claim 17, wherein the aerosol delivery agent comprises an extract derived from the *cannabis* material.

20. A wrapping material as defined in claim 7, wherein the gum has been impregnated into the web.

21. A booklet of wrapping materials comprising:

a stack of individual sheets of a wrapping material as defined in claim 1 and wherein an adhesive is present between adjacent sheets of wrapping material for affixing the individual sheets together in a releasable manner.

* * * * *